US010196960B2

(12) United States Patent
Saindon et al.

(10) Patent No.: US 10,196,960 B2
(45) Date of Patent: Feb. 5, 2019

(54) COOLING SYSTEM HAVING VARIABLE COOLANT FLOW PATHS FOR EXHAUST GAS RECIRCULATION SYSTEM

(71) Applicant: GM GLOBAL TECHNOLOGY OPERATIONS LLC, Detroit, MI (US)

(72) Inventors: William Saindon, Detroit, MI (US); Michele Bilancia, Ruesselsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/454,902

(22) Filed: Mar. 9, 2017

(65) Prior Publication Data

US 2018/0258830 A1 Sep. 13, 2018

(51) Int. Cl.

| | |
|---|---|
| ***F01P 3/20*** | (2006.01) |
| ***F01P 5/10*** | (2006.01) |
| ***F01P 7/14*** | (2006.01) |
| ***F01P 3/18*** | (2006.01) |

(52) U.S. Cl.

CPC ..... *F01P 3/20* (2013.01); *F01P 3/18* (2013.01); *F01P 5/10* (2013.01); *F01P 7/14* (2013.01); *F01P 2007/146* (2013.01); *F01P 2060/18* (2013.01)

(58) Field of Classification Search

CPC ..... F01P 3/20; F01P 5/10; F01P 1/06; F02M 26/44; F02M 31/20

See application file for complete search history.

(56) References Cited

U.S. PATENT DOCUMENTS

| | | | | |
|---|---|---|---|---|
| 8,616,187 | B2 * | 12/2013 | Yamazaki | F01M 5/00 123/568.12 |
| 9,429,064 | B2 * | 8/2016 | Nagahama | F01P 7/16 |
| 2014/0190427 | A1 * | 7/2014 | Nagahama | F01P 7/16 123/41.1 |
| 2014/0372008 | A1 | 12/2014 | Bockenstette et al. | |
| 2016/0230644 | A1 * | 8/2016 | Dudar | F01P 11/16 |

OTHER PUBLICATIONS

Steinparzer, F., et al., "The New Six-Cylinder Diesel Engines from the BMW In-Line Engine Module," 24th Aachen colloquium Automobile and Engine Technology 2015, pp. 31-50.

Jaaskelainen, H., et al., "EGR Systems & Components," retrieved on Aug. 1, 2016 from the internet at https://www.dieselnet.com/tech/engine_egr_sys.php, pp. 1-6.

* cited by examiner

*Primary Examiner* — Long T Tran

(74) *Attorney, Agent, or Firm* — Lorenz & Kopf, LLP

(57) ABSTRACT

A cooling system selectively cools an engine and an exhaust gas recirculation (EGR) component of the engine. The cooling system includes a plumbing system with a plurality of flow branches, including an engine branch, an EGR branch, and a feed branch. The engine branch defines an engine flow passage through which the coolant flows to cool the engine. The EGR branch defines an EGR flow passage through which the coolant flows to cool the EGR component. The feed branch defines a feed flow passage. The cooling system has a first operating configuration in which the EGR flow passage is configured to receive coolant flow from the engine flow passage. The cooling system has a second operating configuration in which the EGR flow passage is configured to receive coolant flow from the feed flow passage instead of the engine flow passage.

20 Claims, 5 Drawing Sheets

COOLING SYSTEM HAVING VARIABLE COOLANT FLOW PATHS FOR EXHAUST GAS RECIRCULATION SYSTEM

TECHNICAL FIELD

The present disclosure pertains to a cooling system for a vehicle and, more particularly, pertains to a cooling system having variable coolant flow paths for an exhaust gas recirculation system.

BACKGROUND

An internal combustion engine conventionally includes an engine block with at least one cylinder. Each cylinder accommodates a piston, which is connected to a crankshaft via a connecting rod and, in conjunction with a cylinder head, defines a combustion chamber. A mixture of air and fuel is introduced into the combustion chamber and ignited in a cyclical manner, thereby producing rapidly expanding gases that drive linear movements of the piston, which in turn are converted into rotation of the crankshaft by the connecting rod.

Some engines may be configured with an exhaust gas recirculation (EGR) system. EGR systems generally reduce the amount of one or more substances (e.g., NOx) that are emitted into the atmosphere with the engine exhaust gas. In typical EGR systems, a portion of the exhaust gas is recirculated back to an intake side of the engine and combusted with the air/fuel mixture in the engine cylinders for reducing the amount of NOx emitted to the atmosphere.

Vehicle EGR devices may include a cooling system for cooling one or more components. However, operation of the EGR cooling system can have a negative impact on other vehicle systems. For example, the EGR cooling system may affect operating temperatures of the engine, which may cause the engine to operate inefficiently, degrade fuel efficiency, or produce other undesirable effects.

Accordingly, it is desirable to provide an EGR cooling system that effectively cools the EGR system components without negatively affecting operations of the engine and/or other vehicle systems. Other objects, desirable features and characteristics will and/or other vehicle systems. Other objects, desirable features and characteristics will become apparent from the subsequent summary and detailed description, and the appended claims, taken in conjunction with the accompanying drawings and this background.

SUMMARY

An internal combustion engine for a vehicle is disclosed that includes an exhaust gas recirculation (EGR) system configured to receive exhaust gas produced by the engine and to recirculate the exhaust gas back to the engine. The EGR system includes an EGR component. A cooling system is provided to selectively cool the engine and the EGR component. The cooling system includes a coolant pump and a plumbing system with a plurality of flow branches arranged to circulate coolant pumped by the coolant pump through the cooling system. The plurality of flow branches includes an engine branch, an EGR branch, and a feed branch. The engine branch defines an engine flow passage through which the coolant flows to cool the engine. The EGR branch defines an EGR flow passage through which the coolant flows to cool the EGR component. The feed branch defines a feed flow passage. The cooling system has a first operating configuration in which the EGR flow passage is configured to receive coolant flow from the engine flow passage. The cooling system has a second operating configuration in which the EGR flow passage is configured to receive coolant flow from the feed flow passage instead of the engine flow passage.

Moreover, an internal combustion engine for a vehicle is disclosed that includes an exhaust gas recirculation (EGR) system configured to receive exhaust gas produced by the engine and recirculate the exhaust gas back to the engine. The EGR system includes an EGR component. A cooling system is provided to selectively cool the engine and the EGR component. The cooling system includes a coolant pump and a plumbing system with a plurality of flow branches arranged to circulate coolant pumped by the coolant pump through the cooling system. The plumbing system fluidly connects the coolant pump to the engine. The plumbing system fluidly connects the coolant pump to the EGR system. The cooling system is configurable between a first operating configuration and a second operating configuration. In the first operating configuration, the plumbing system fluidly connects the engine and the EGR system in series. In the second operating configuration, the plumbing system fluidly connects the engine and the EGR system in parallel.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the scope of the present disclosure or the application and uses of the present disclosure. Furthermore, there is no intention to be bound by any theory presented in the preceding background or the following detailed description.

Figure 1:
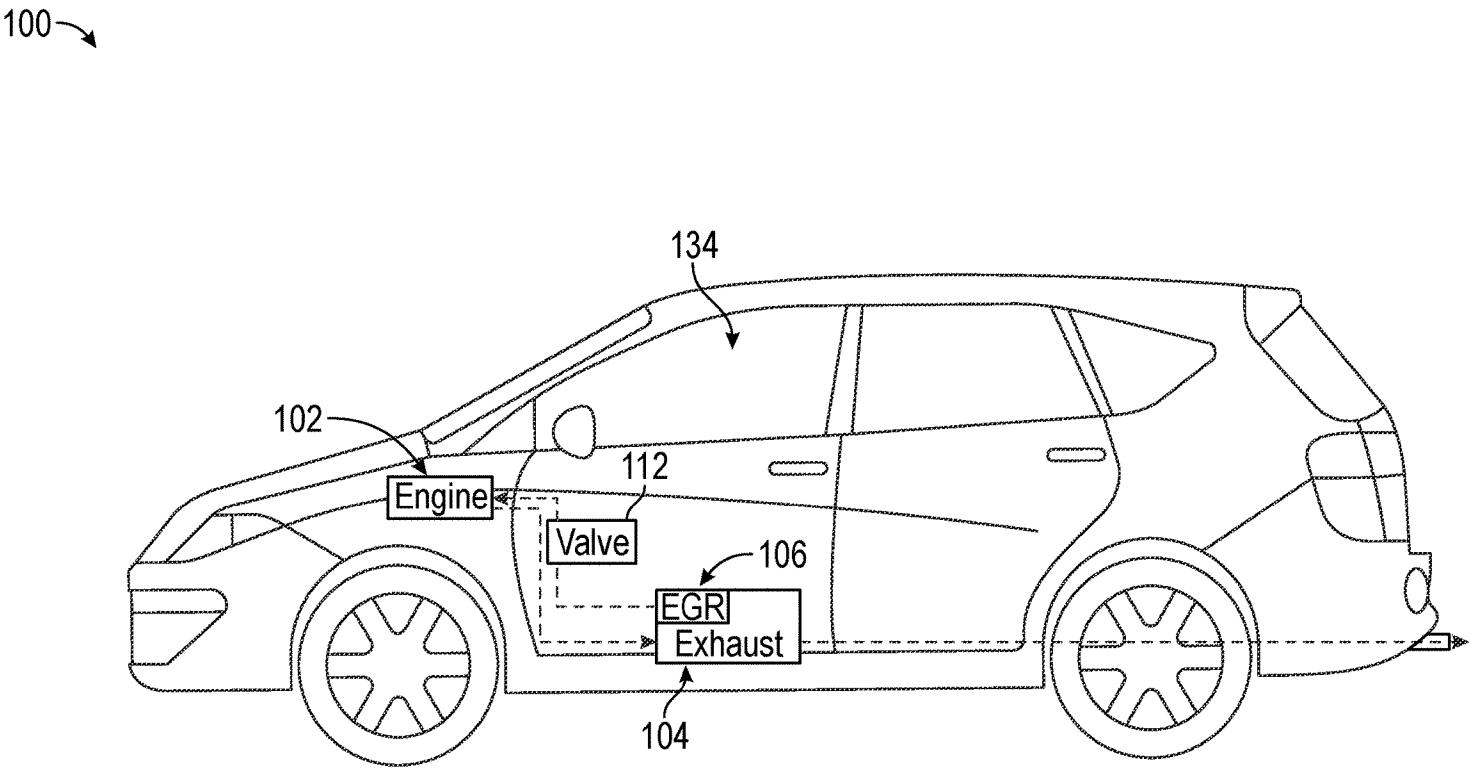
FIG. 1 is a side view of a vehicle with a cooling system of the present disclosure.
Figure 2:
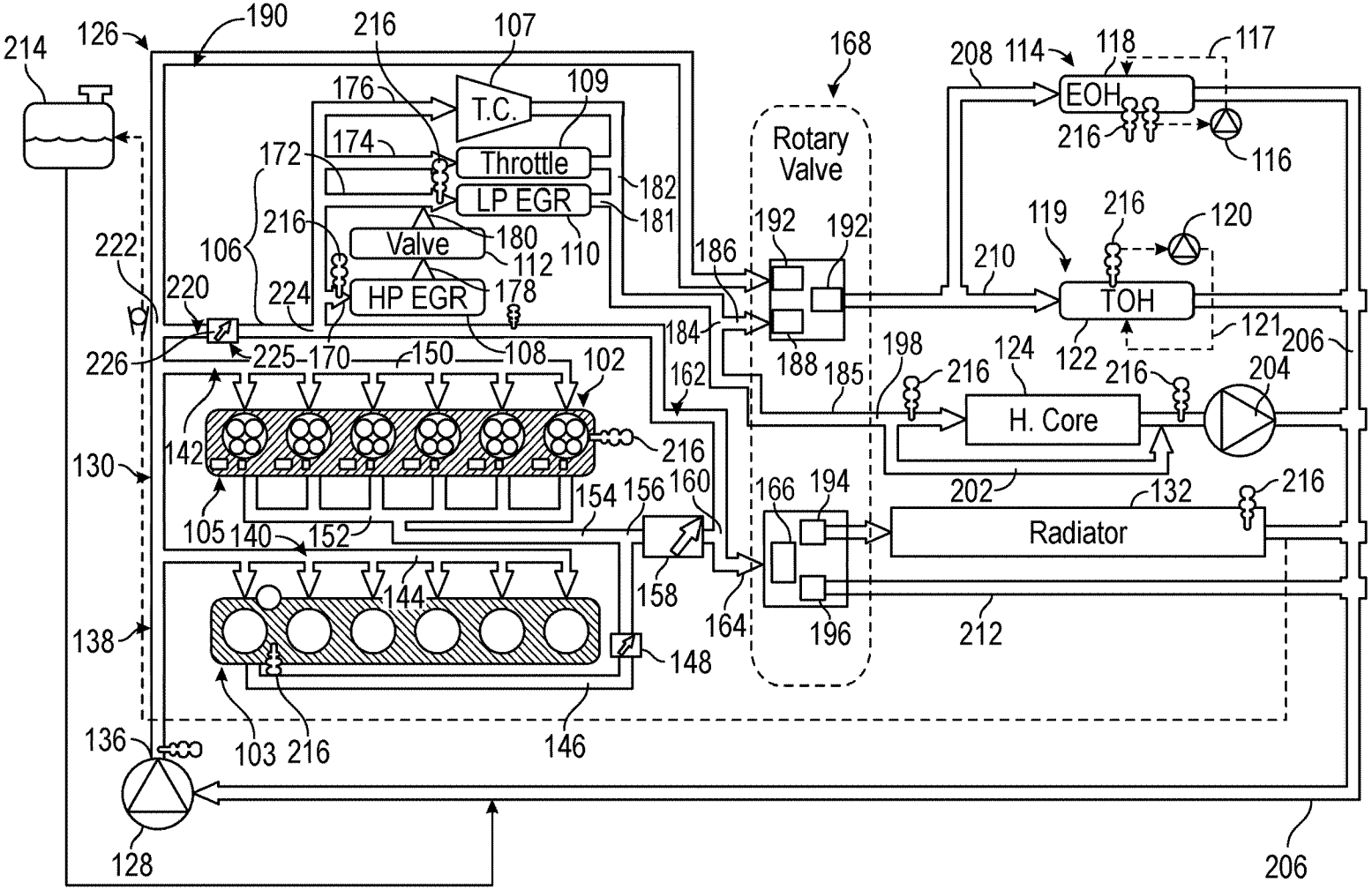
FIG. 2 is a schematic view of a cooling system of the vehicle of FIG. 1 according to example embodiments of the present disclosure.

Some embodiments may include a motor vehicle 100 as shown in FIG. 1. As shown in FIGS. 1 and 2, the vehicle 100 may include an internal combustion engine (ICE) 102. In some embodiments, the engine 102 may be a diesel engine; however, it will be appreciated that the engine 102 may of other types without departing from the scope of the present disclosure.

As shown in FIG. 2, the engine 102 may include an engine block 103 and a cylinder head 105. The engine block 103 may define at least one cylinder with a piston disposed therein. The piston may include a linkage with which a crankshaft is turned. The cylinder head 105 is attached to the engine block 103 to close off the cylinder, such that the cylinder head 105 and engine block 103 collectively define a combustion chamber. An air-fuel mixture is introduced into the combustion chamber and ignited, resulting in hot, expanding combustion gases, which cause the piston to move back and forth within the cylinder. Exhaust gas may be produced by the engine 102 as a result of the combustion.

The vehicle 100 may additionally include an exhaust system 104. The exhaust system 104 may include one or more members (e.g., exhaust pipes, lines, flow passages, etc.) for directing flow of the exhaust gases produced by the engine 102.

In some embodiments, a turbocharger component 107 may be included as part of the exhaust system 104. The turbocharger component 107 may be of a known type and may include a turbine section and a compressor section. The turbine section may be driven in rotation by the exhaust flowing through the exhaust system 104, causing rotation of the compressor section. The compressor section, in turn, compresses air flowing into the combustion chambers of the engine 102. An intercooler or other similar device may also be included for cooling the temperature of the compressed air flowing out of the compressor section and toward the engine 102.

Moreover, the vehicle 100 may include a throttle 109. The throttle 109 may be generally referred to as an air management valve. The throttle 109 may regulate intake air of the engine 102 and/or control exhaust gas recirculation in some embodiments. Also, in some embodiments, the position of the throttle 109 may be detected and/or controlled to affect the amount of fuel injected into the combustion chambers of the engine 102.

Additionally, the exhaust system 104 of the vehicle 100 may also include one or more aftertreatment devices configured to treat the exhaust gases, for example, to reduce the amount of substances (e.g., NOx, soot, etc.) included in the exhaust gas flow. Furthermore, the exhaust system 104 may include components (e.g., a tailpipe, etc.) that direct flow of the exhaust gas to the atmosphere. Other components, such as an exhaust gas recirculation (EGR) system 106 (FIG. 2), may be included that recirculate flow of the exhaust gas back toward an inlet side of the engine 102. The EGR system 106 may recirculate exhaust gas back to the engine 102 to, for example, reduce NOx emissions of the vehicle 100.

The EGR system 106 may be a known EGR system and may include one or more EGR components, such as a short route or high pressure (HP) EGR component 108 and a long route or low pressure (LP) EGR component 110. The HP EGR component 108 may receive exhaust directly from an exhaust manifold and direct the exhaust gas back toward an intake manifold of the engine 102. Exhaust gas flow through the HP EGR component 108 may be controlled by an exhaust gas recirculation valve 112. The LP EGR component 110 may receive exhaust gas flow from an aftertreatment device, such as a deisel particulate filter (not shown). The LP EGR component 110 may feed this exhaust gas back to the intake system of the engine 102.

Furthermore, the vehicle 100 may include at least one lubrication system 114, 119. For example, the vehicle 100 may include an engine lubrication system 114 and a transmission lubrication system 119.

The engine lubrication system 114 may include an engine oil pump 116 and an oil circuit 117. The oil circuit 117 is configured to circulate oil that is pumped by the oil pump 116 through the engine lubrication system 114. While the oil circuit 117 is partially shown, it will be understood that the oil circuit 117 may circulate oil through the engine 102 to lubricate one or more moving parts of the engine 102 (e.g., parts associated with the drive shaft, etc.). The engine lubrication system 114 may further include an engine oil heater 118. The engine oil heater 118 may be configured for selectively heating oil within or that is flowing into the engine block 103. The applied heat may reduce the viscosity of the oil pumped by the pump 116, for example, to make the engine 102 easier to start in cold-weather conditions.

Moreover, the transmission lubrication system 119 may include a fluid pump 120 and a fluid circuit 121. The fluid circuit 121 is configured to circulate transmission fluid that is pumped by the fluid pump 120 through a transmission assembly of the vehicle 100. It will be appreciated that the transmission assembly may include one or more series of meshing/meshable gears, a plurality of shafts that supports the gears, etc. The transmission assembly may transmit torque and power from a drive shaft of the engine 102 to wheels of the vehicle 100. The transmitted torque may be subject to different gear ratios applied by the transmission assembly in different transmission modes as well. Also, the fluid circuit 121 is partially shown, but it will be understood that the fluid circuit 121 may circulate transmission fluid through the transmission assembly to lubricate the gears, shafts, etc. of the transmission assembly. The transmission lubrication system 119 may further include a transmission fluid heater 122. The transmission fluid heater 122 may be configured for selectively heating the transmission fluid that is within or that is flowing into the transmission assembly. The applied heat may reduce the viscosity of the transmission fluid, for example, thereby increasing efficiency of the transmission assembly.

The vehicle 100 may further include a cooling system 126, which is illustrated in detail in FIG. 2 according to example embodiments. Generally, the cooling system 126 may be configured for selective cooling of (i.e., removal of heat from) the engine 102, the EGR system 106, and/or other components and systems of the vehicle 100. The cooling system 126 may also be configured for selective heating (i.e., providing heat to) some components of the vehicle 100. In some embodiments, for example, the cooling system 126 may receive heat from the engine 102 and/or the EGR system 106 to cool those components, and the cooling system 126 may also transfer heat to the engine oil heater 118, the transmission oil heater 122, and/or other components of the vehicle 100.

As shown in FIG. 2, the cooling system 126 may generally include a coolant pump 128 and a plumbing system 130. The coolant pump 128 may pump a coolant through the plumbing system 130. The plumbing system 130 may include a plurality of flow branches (i.e., flow lines, pipes, etc.) arranged to circulate coolant pumped by the coolant pump 128 through the cooling system 126.

The cooling system 126 may further include a radiator 132. The radiator 132 may be a heat exchanger with a plurality of spaced apart fins that are exposed to the atmosphere. The plumbing system 130 may be fluidly connected to the radiator 132 as will be discussed in detail below. As such, in some operating configurations of the cooling system 126, coolant may flow from the pump 128, gather heat from the engine 103, the EGR system 106 and/or other components, and the heated coolant may flow to the radiator 132 such that heat from the coolant transfers to the atmosphere and is, therefore, cooled down again. Then, the cold coolant may flow back to the pump 128.

Furthermore, the cooling system 126 may further include a heater core 124. The heater core 124 may be a heat exchanger with a plurality of spaced apart fins that are disposed within a duct that is fluidly connected to the interior of a passenger cabin 134 of the vehicle 100. A fan may selectively blow on the heater core 124, and the blown air may exchange heat with the coolant flowing through the heater core 124. The plumbing system 130 may be fluidly connected to the heater core 124 as will be discussed in detail below. As such, in some operating configurations of the cooling system 126, coolant may flow from the pump 128, gather heat from the engine 103, the EGR system 106 and/or other components, and the heated coolant may flow to the heater core 124 such that heat from the coolant transfers to the air blown across the heater core 124 for heating the interior of the passenger cabin 134 of the vehicle 100. The coolant may exit the heater core 124 and flow back to the pump 128.

As will be discussed, the cooling system 126 may change between a plurality of different operating configurations (i.e., different configurations). Coolant may flow along different paths through the plumbing system 130 in the different operating configurations. In some embodiments, the cooling system 126 may change from one operating configuration to another to change the route of the coolant through the cooling system 126. Also, in some embodiments, the operating configuration of the cooling system 126 may change to alter a flow rate of the coolant through a particular component (e.g., the engine 102 and/or the EGR system 106). In some embodiments, for example, the cooling system 126 may have a first operating configuration in which the EGR system 106 is cooled by coolant, at least some of which, is flowing generally away from the engine 102. In this example, the cooling system 126 may also have a second operating configuration in which the EGR system 106 is cooled by coolant that has bypassed the engine 102. In some embodiments, the cooling system 126 may be in the first operating configuration when the engine 102 has warmed up (i.e., is above a predetermined threshold temperature). In this example, the cooling system 126 may alternatively be in the second operating configuration when the engine 102 is cold (i.e., is below a predetermined threshold temperature). Thus, for example, during a start and initial warm-up of the engine 102 in cold weather conditions, the cooling system 126 may be in the second operating configuration. Thus, coolant flow through the engine 102 may be reduced and/or prevented, allowing the engine 102 to warm up in a relatively short amount of time. Also, coolant that bypasses the engine 102 may flow through the EGR system 106 for cooling the EGR system 106. These and other features of the cooling system 126 will be discussed in detail below according to example embodiments of the present disclosure.

The operating configurations of the cooling system 126 may be selected (i.e., may be selectable). In some embodiments, the operating configuration may be automatically selected by an electronic control system that operates according to programmed control logic. In other embodiments, the operating configuration may be automatically changed using mechanical, hydraulic, and/or temperature-dependent components without the use of a computerized control system.

Referring now to FIG. 2, the cooling system 126 will be discussed in more detail. It will be appreciated that the illustrated embodiment in FIG. 2 is an example of the cooling system 126 of the present disclosure. Certain features may vary from the embodiments shown in FIG. 2 and described below.

The plumbing system 130 of the cooling system 126 will be described as having a plurality of flow branches. Each flow branch may include one or more hollow pipes, tubes, lines, flow members, or other components that define fluid passages through the cooling system 126. These components may be constructed from any suitable material and may be rigid or flexible. The flow branches may also include one or more flow control devices configured to control flow characteristics (e.g., a mass or volumetric flow rate) through the respective flow passageway of the flow branch. For example, at least one flow branch may include a valve for changing flow through the respective branch. Additionally or alternately, at least one flow branch may include a member with an orifice that restricts flow in a predetermined manner.

The plumbing system 130 may additionally include one or more junctions. The junctions may provide fluid connection between two different flow branches. Some junctions may receive flow input from two or more flow branches and output a combined flow to another branch. Other junctions may receive a flow input from a flow branch and may output the flow to two or more branches.

In the embodiment of FIG. 2, for example, the cooling system 126 may include a common flow branch 138. The common flow branch 138 may extend away from a pump outlet 136. As such, the flow passage of the common flow branch 138 may receive coolant pumped out of the pump 128.

Also, as shown in FIG. 2, the plumbing system 130 may include a first engine flow branch 140 and a second engine flow branch 142. The first engine flow branch 140 may extend away from the common flow branch 138 and may provide coolant flow to the engine block 103. The second engine flow branch 140 may extend away from the common flow branch 138 and may provide coolant flow to the cylinder head 105. In some embodiments, the first and second engine flow branches 140, 142 may extend in parallel from the common flow branch 138 (i.e., coolant flow from the common branch 138 may be split, in some situations, between the first and second flow branches 2). Accordingly, the respective flow passages defined by the first and second flow branches 140, 142 may directly receive coolant flow from the common flow branch 138.

The first engine flow branch 140 may include an inlet manifold 144 that distributes coolant to the engine block 103. Also, the first engine flow branch 140 may include an outlet portion 146. Coolant may flow from the inlet manifold 144 and into the outlet portion 146 allowing the coolant to receive heat from (and cool) the engine block 103. The outlet portion 146 may also include a block valve 148 in some embodiments. The block valve 148 may be moveable between an open position and a closed position. In the open position, the block valve 148 may allow flow through the first engine flow branch 140.

The second engine flow branch 142 may include an inlet manifold 150 that distributes coolant to the cylinder head 105. Also, the second engine flow branch 142 may include an outlet manifold 152 and, further downstream, an outlet portion 154. Coolant may flow from the inlet manifold 150, across the cylinder head 105, and into the outlet manifold 152, allowing the coolant to receive heat from (and cool) the cylinder head 105.

The plumbing system 130 may further include a first junction 156. In some embodiments, the junction 156 may be a three-way junction with two inputs and one output. The junction 156 may fluidly connect the outlet portion 146 of the first engine flow branch 140 and the outlet portion 154 of the second engine flow branch 142. Thus, the junction 156 may combine the flow from both the first and second engine flow branches 140, 142 and output the combined flow toward other downstream components toward an engine coolant flow control valve 158.

The engine coolant flow control valve 158 receive combined flow of the first and second engine flow branches 140, 142. In some embodiments, the valve 158 may have at least one ON position allowing coolant flow therethrough, and an OFF position preventing coolant flow through one or both engine flow branches 140, 142. In some embodiments, the valve 158 may be adjustable between a plurality of ON positions, and the flow rate through the valve 158 (e.g., the mass flow rate through the valve 158) may be different in each position.

Moreover, the plumbing system 130 may include a second junction 160. In some embodiments, the second junction 160 may be a three-way junction with one input and two outputs. The junction 160 may receive flow from the valve 158 and may split that flow between an EGR branch 162 and a first feed 164. The first feed 164 may provide flow to a first port 166 of a variable valve 168, which will be discussed in detail below.

The EGR branch 162 may be divided into various sub-branches. Some of these sub-branches may be fluidly connected in-series (flow from one sub-branch is received by another sub-branch). Others may be fluidly connected in-parallel to each other (input flow may be split between multiple sub-branches).

For example, the EGR branch 162 may include a first sub-branch 170 that provides coolant to the HP EGR component 108 for cooling the HP EGR component 108. The EGR branch 162 may also include a second sub-branch 172 that provides coolant to the LP EGR component 110 for cooling the LP EGR component 110. Also, the EGR branch 162 may include a third sub-branch 174 that provides coolant to and cools the throttle 109, and a fourth sub-branch 176 that provides coolant to and cools the turbocharger component 107. The first, second, third, and fourth sub-branches 170, 172, 174, 176 may be fluidly connected in parallel as shown in FIG. 2. In other words, input flow from the junction 160 may, in some situations, be split between the first, second, third, and fourth sub-ranches. Additionally, a first intermediate sub-branch 178 may be fluidly connected to the HP EGR 108 and the valve 112 to allow coolant to flow from the HP EGR 108 to the valve 112. Likewise, a second intermediate sub-branch 180 may be fluidly connected to the valve 112 and the second sub-branch 172 to allow coolant to flow from the valve 112 to the LP EGR component 110. Thus, the HP EGR component 108, the valve 112, and the LP EGR component 110 may be fluidly connected in series in some embodiments.

Additionally, an EGR outlet 181 may be fluidly connected downstream of the LP EGR component 110 and may extend to a common outlet member 182. The common outlet member 182 may also receive flow 183 from the outlet of the throttle 109 and/or the turbocharger 107. The outlet member 182 may extend from these components to a third junction 184. In some embodiments, the third junction 184 may be a three-way junction with one input and two outputs. The junction 184 may receive flow from the outlet member 182 and may split that flow between a core feed branch 185 and a second feed 186 to a second port 188 of the variable valve 168.

Moreover, the plumbing system 130 may include a direct flow branch 190. The direct flow branch 190 may extend away from the common flow branch 138 and may extend to a third port 192 of the variable valve 168. Accordingly, flow through the direct flow branch 190 may be directed from the common flow branch 138 to the third port 192 and may bypass the engine 102 and the EGR system 106 (here, the HP EGR 108, the valve 180, and the LP EGR 110) as well as the throttle 109 and the turbocharger component 107.

The variable valve 168 may be a rotary valve in some embodiments. Additionally, the variable valve 168 may include a first outlet port 192, a second outlet port 194, and a third outlet port 196. The first outlet port 192 may be configured to receive flow from the second feed 186 and/or the direct flow branch 190, depending on the position of the variable valve 168. Additionally, flow from the first feed 164 may be input to the first port 166 and output via the second outlet port 194 and/or the third outlet port 196, depending on the position of the variable valve 168.

Additionally, the core feed branch 185 may bypass the variable valve 168 and extend toward the heater core 124. In some embodiments, the core feed branch 185 may extend from the junction 184 to a fourth junction 198. The junction 198 may split flow from the core feed branch 185 between the core path 200 and the core bypass 202. In some embodiments, flow from the core path 200 and the core bypass 202 may be input to a second coolant pump 204.

The second coolant pump 204 may pump this coolant to a return branch 206 of the plumbing system 130. The return branch 206 may allow coolant flow back to the pump 128 for re-circulation through the cooling system 126.

The plumbing system 130 may further include an engine oil heater branch 208 and a transmission fluid heater branch 210. Flow to these branches may be provided commonly from first outlet port 192. Downstream of the port 192, the branches 208, 210 may be fluidly connected in parallel, meaning that coolant flow is split between the two branches 208, 210. Output from these branches 208, 210 may merge again into the return branch 206 as shown in the embodiment of FIG. 2.

Furthermore, the radiator 132 may be fluidly connected to the second outlet port 194. The outlet of the radiator 132 may be fluidly connected to the return branch 206 as shown in FIG. 2.

Additionally, the third outlet port 196 may be directly and fluidly connected to the return branch 206 via a flow branch 212.

The cooling system 126 may further include a surge tank 214. The surge tank 214 may receive flow input from the radiator 132, and the surge tank 214 may output coolant back to the return branch 206.

Moreover, the cooling system 126 may include a plurality of sensors 216. The sensors 216 may be used for observing one or more conditions. For example, the sensors 216 may detect temperature and/or flow conditions of the coolant at one or more locations of the cooling system 126. There may be any suitable number of sensors 216. The sensors 216 may be located throughout the cooling system 126. In some embodiments, one or more sensors 216 may be thermometers for detecting temperature of the coolant at the respective location of the cooling system 126. Also, in some embodiments, one or more sensors 216 may be flow sensors for detecting flow characteristics (e.g., mass flow rate) of the coolant at the respective location of the cooling system 126.

Furthermore, the cooling system 126 may include an EGR feed branch 220. The EGR feed branch 220 may include a pipe with an inlet end 222 and an outlet end 224. The EGR feed branch 220 may define a feed flow passage and a fluid pathway for coolant to flow from the inlet end 222 to the outlet end 224.

The inlet end 222 may be fluidly connected to the common flow branch 138. In some embodiments, the inlet end 222 may be connected to the common flow branch 138 between the second engine flow branch 142 and the direct flow branch.

The outlet end 224 may be fluidly connected to the EGR branch 162. In some embodiments, the outlet end 224 may be connected to the EGR branch 162 at a location that is upstream of the first, second, third, and fourth sub-branches 170, 172, 174, 176. As such, the outlet end 224 may be connected to EGR branch 162 at a location that is upstream of the EGR system 106 (i.e., the HP EGR component 108, the LP EGR component 110) as well as the throttle 109 and the turbocharger component 107. Accordingly, in some situations, flow from the EGR feed branch 220 may be received in the sub-branches 170, 172, 174, 176, EGR system 106, the throttle 109, and/or the turbocharger component 107.

It will be appreciated that the EGR feed branch 220, the first engine flow branch 140, the second engine flow branch 142, and the direct flow branch 190 may extend in parallel from the common flow branch 138 as shown in the embodiment of FIG. 2. Accordingly, these branches 220, 140, 142, 190 may each receive coolant flow directly from the common flow branch 138, and flow from the pump 128 may be split, in some situations, between the first engine flow branch 140, the second engine flow branch 142, the EGR feed branch 220, and the direct flow branch 190.

Additionally, in some situations, the EGR feed branch 220 may provide coolant flow directly from the common flow branch 138 to the first sub-branch 170 of the EGR branch 162 for feeding coolant to the HP EGR component 108. Also, the EGR feed branch 220 may provide coolant flow directly from the common flow branch 138 to the second sub-branch 172 for feeding coolant to the LP EGR component 110.

The EGR feed branch 220 may include a flow regulator 225. The flow regulator 225 may be configured for regulating and/or controlling a flow characteristic of coolant flowing through the EGR feed branch 220. In some embodiments, the flow regulator 225 may be operably and fluidly connected to the EGR feed branch 220, between the inlet end 222 and the outlet end 224.

In some embodiments, the flow regulator 225 may include an orifice having a predetermined size. The cross-sectional size of the orifice (measured perpendicular to the flow direction) may be smaller than that of adjacent portions of the feed branch 220. The size of the orifice may be configured such that coolant flow, coolant flow rate, etc. is limited through the flow regulator 225.

Alternatively, in some embodiments, the flow regulator 225 may include an EGR feed valve 226 configured to selectively change a flow characteristic of coolant flowing through the EGR feed branch 220. In some embodiments, the EGR feed valve 226 may be moveable between a first position and a second position. In some embodiments, the first position may be a closed position to prevent substantially all coolant flow through the EGR feed branch 220. Additionally, in some embodiments, the second position may be an open position, thereby allowing flow through the EGR feed branch 220. In further embodiments, the EGR feed valve 226 may be selectively positionable in a plurality of positions, allowing flow through the feed branch 220 in more than one position; however, the flow rate (e.g., mass flow rate) through the EGR feed branch 220 may vary depending on the position of the valve 226.

In additional embodiments, the EGR feed valve 226 may be moveable between a first position, a second position, and at least one additional position. At least one of these positions may be a closed position to prevent coolant flow through the feed branch 220. Also, the flow rate through the EGR feed branch 220 may differ depending on the position of the feed valve 226.

In some embodiments, the position of the EGR feed valve 226 may be electrically controlled by a computerized controller, processor, control logic, etc. In some embodiments, the valve 226 may be controlled by an ECU of the vehicle 100. Furthermore, in some embodiments, the ECU may receive sensor data (e.g., coolant temperature data, coolant flow data, etc.) from the sensors 216, and with this data, the ECU may change position of the EGR feed valve 226. In other embodiments, the position of the EGR feed valve 226 may be mechanically controlled (i.e., without computerized control, processor, control logic, etc.).

The EGR feed valve 226 may include various features. In some embodiments, the valve 226 may include a thermostat, or other components that automatically change the position of the feed valve 226, depending on temperature of the coolant. Also, the EGR feed valve 226 may be a one-way check valve in some embodiments. Accordingly, the feed valve 226 may be biased toward a closed position so that there is substantially no flow through the EGR feed branch 220; however, fluid pressure on the EGR feed valve 226 may serve to open the EGR feed valve 226 to allow flow through the EGR feed valve 226.

Figure 3:
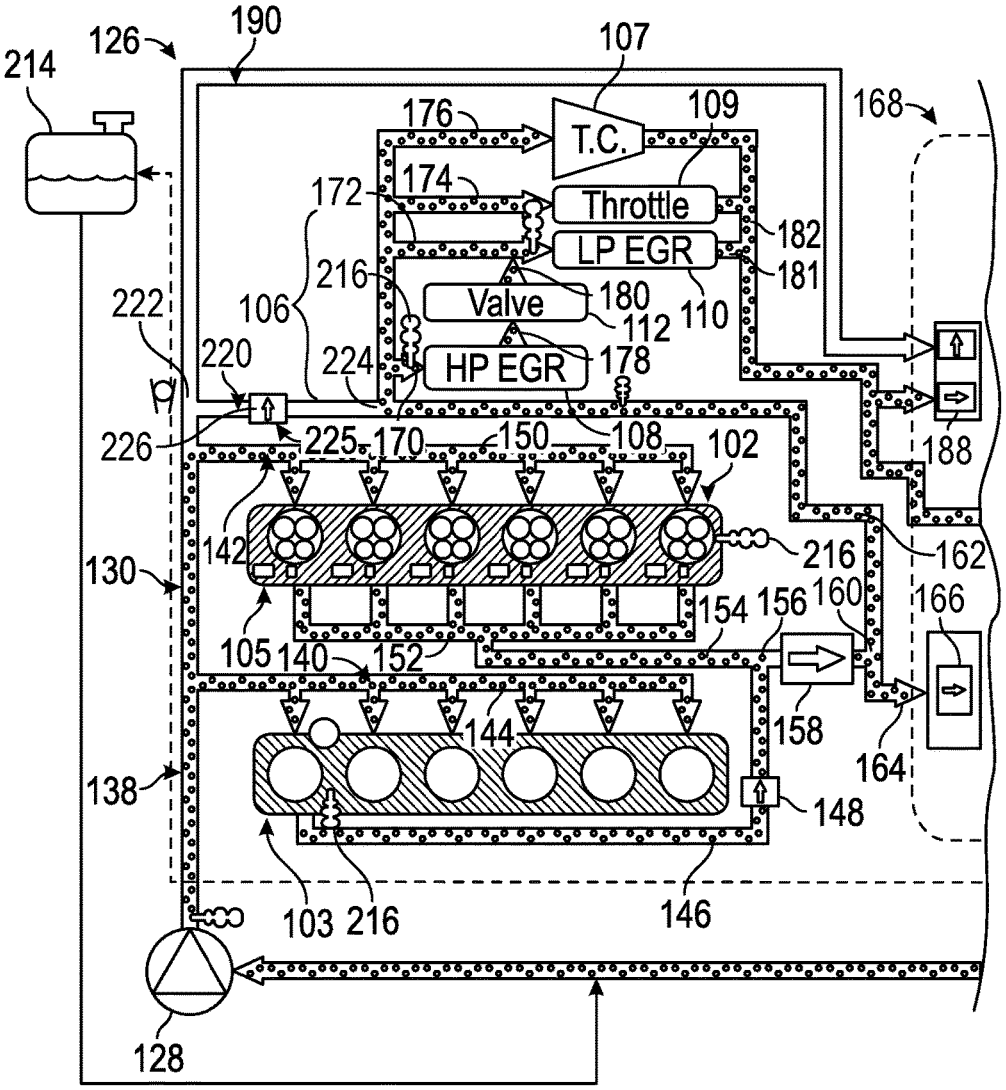
FIG. 3 is a schematic view of the cooling system of FIG. 2, shown in a first operating configuration.
Figure 4:
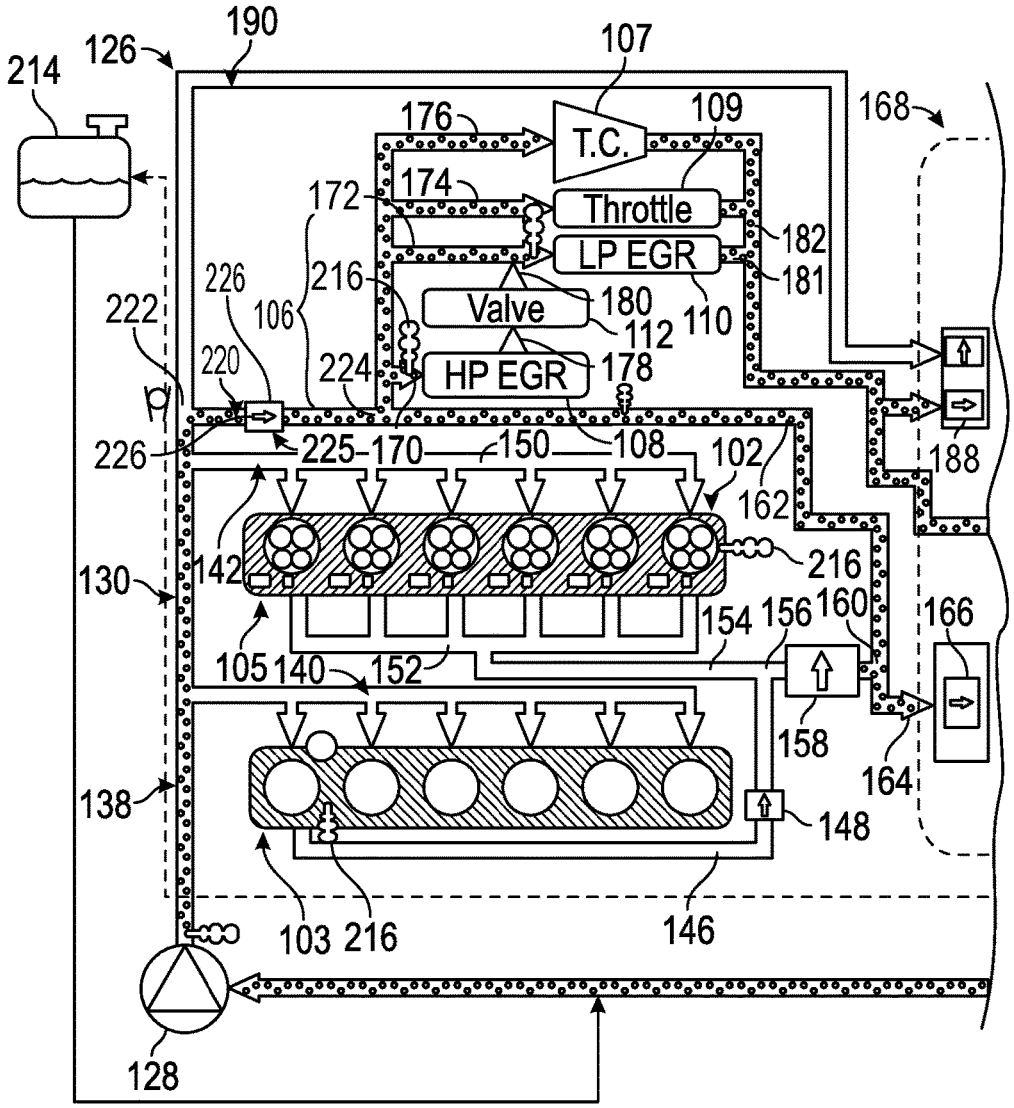
FIG. 4 is a schematic view of the cooling system of FIG. 2, shown in a second operating configuration.

Referring now to FIGS. 3 and 4, different operating configurations of the cooling system 126 of FIG. 2 will be discussed. In each operating configuration, the coolant may circulate through the cooling system 126 along different flowpaths (i.e., different flow passages).

In the illustrated embodiment, components that are upstream of the variable valve 168 (e.g., the engine block 103, the cylinder head 105, the HP EGR 108, the valve 112, the LP EGR 110, the throttle 109, and the turbocharger component 107) may be cooled by the cooling system 126. In other words, heat from those components may be transferred to the coolant as it is circulated through the cooling system 126. In contrast, components that are downstream of the variable valve 168 (e.g., the engine oil heater 118, the transmission oil heater 122, the heater core 124, and the radiator 132) may receive heat from the coolant. In the case of the engine oil heater 118 and the transmission oil heater 122, heat from the coolant may heat the respective oil within the component. In the case of the heater core 124 and the radiator 132, heat from the coolant may be transferred to the air flowing around those components.

In some embodiments, the operating configuration of the cooling system 126 may be changed when the position of the engine coolant control valve 158 and/or the EGR feed valve 226 is changed. In the operating configuration of FIG. 3, for example, the engine coolant control valve 158 is shown in an ON position and the EGR feed valve 226 is shown in an OFF position. In contrast, in the operating configuration of FIG. 4, for example, the engine coolant control valve 158 is shown in an OFF position and the EGR feed valve 226 is shown in an ON position. Other valves 168 (e.g., the block valve 148, the recirculation valve 112, the variable valve 168, etc.) may be in the same position in both FIGS. 3 and 4. It will be appreciated, however, that the cooling system 126 may have different operating configurations and/or additional operating configurations for providing other coolant flowpaths without departing from the scope of the present disclosure.

In the operating configuration of FIG. 3, the pump 128 may pump coolant through the common flow branch 138. This flow may split off into the first and second engine flow branches 142, 140 for providing coolant flow (and cooling)

of the engine 102. This flow may merge at the junction 158 and flow through the engine coolant control valve 158. The flow may again split at the junction 160. Some flow may flow into the port 166, and some of the flow may flow into the EGR branch 162. The flow in the EGR branch 162 may supply coolant in parallel to the HP EGR component 108, the valve 112, the LP EGR component 110, the throttle 109, and the turbocharger component 107 as shown. This flow may subsequently flow to the common outlet member 182 and to the port 188 of the variable valve 168.

Accordingly, in the operating configuration of FIG. 3, coolant flow from the engine 102 (i.e., coolant flow from the flow branches 140, 142) may be received in-series by the EGR branch 162. Also, the EGR feed valve 226 may prevent flow through the EGR feed branch 220. In some embodiments, the operating configuration of FIG. 3 may be suitable for situations in which the temperature of the engine 102 is at least equal to a predetermined threshold. For example, the operating condition of the cooling system 126 of FIG. 3 may be useful for when the engine 102 has warmed up and needs cooling. The EGR components 108, 110, the throttle 109, and the turbocharger component 107 may receive coolant flow as well for cooling.

In contrast, in the operating configuration of FIG. 4, the pump 128 may pump coolant through the common flow branch 138. This flow may be received by the EGR feed branch 220 and flow into the EGR branch 162 for delivery to the HP EGR component 108, the valve 112, the LP EGR component 110, the throttle 109, and the turbocharger component 107 as shown. This flow may subsequently flow to the common outlet member 182 and to the port 188 of the variable valve 168.

Accordingly, in the operating configuration of FIG. 4, the engine coolant control valve 158 may prevent coolant from flowing through the engine 102. In some embodiments, the operating configuration of FIG. 4 may be suitable for situations in which the temperature of the engine 102 is below a predetermined threshold. For example, the operating condition of the cooling system 126 of FIG. 4 may be useful for when the engine 102 is starting up and is cold. Because the coolant is prevented from flowing through the engine 102, the engine may warm up relatively quickly while still allowing cooling of the HP EGR component 108, the valve 112, the LP EGR component 110, the throttle 109, and the turbocharger component 107.

Figure 5:
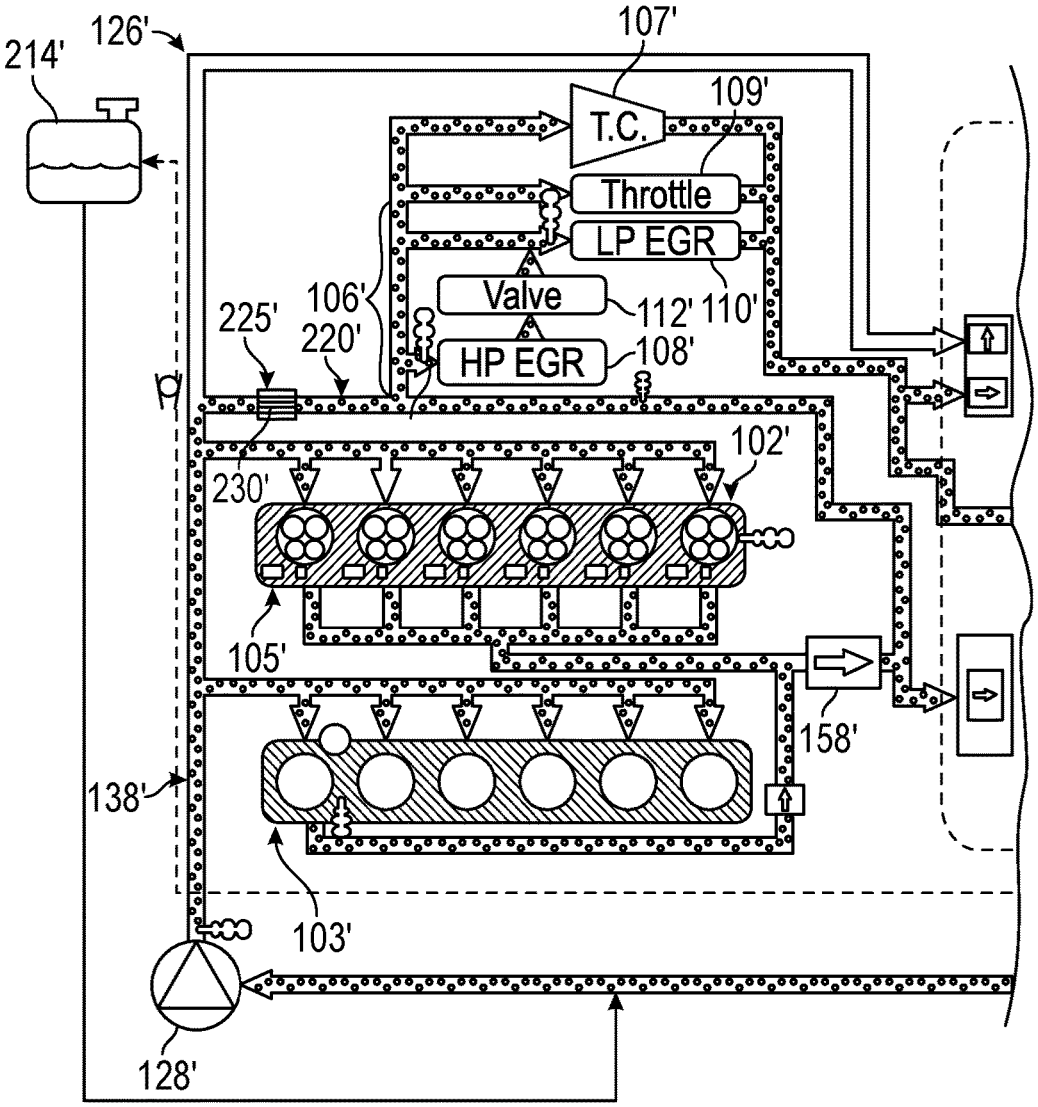
FIG. 5 is a schematic view of the cooling system of FIG. 2 according to additional embodiments.

Additional embodiments of the cooling system 126' of the present disclosure are represented in FIG. 5. The cooling system 126' may be substantially similar to the embodiments discussed above except as noted below. Components that are similar to those discussed above are indicated in FIG. 5 with corresponding reference numbers, but with an added prime symbol.

In this embodiment, the flow regulator 225' may be an orifice member with an orifice 230' extending therethrough. The cross-sectional size of the orifice 230' (measured perpendicular to the flow direction) may be smaller than that of adjacent portions of the feed branch 220'. The size of the orifice 230' may be configured such that coolant flow, coolant flow rate, etc. is limited through the flow regulator 225'.

In the operating configuration of FIG. 5, the engine coolant control valve 158' may be in an ON position. As such, flow from the common flow branch 138' may be split for parallel coolant flow between the engine block 103', the cylinder head 105', and the EGR system 106'. The orifice 230' of the flow regulator 225' may reduce flow through the feed branch 220', however, so that the pump 128' may pump coolant to each branch.

The operating configuration of FIG. 5 may correspond to the operating configuration of FIG. 3 in that both may be suitable in situations in which the engine 102' has warmed up. The operating configuration of the cooling system 126' of FIG. 5 may also include another operating configuration that is substantially similar to FIG. 4. More specifically, the engine coolant control valve 158' may be turned OFF, and the orifice 230' may allow flow to the EGR system 106'. Thus, the engine 102' may warm up relatively quickly, and coolant may continue to be delivered to the EGR system 106', similar to the embodiments discussed above.

Thus, the cooling systems 126, 126' of the present disclosure provide selectable and cooling between the engine 102, 102' and the EGR system 106, 106' as well as selectable cooling of other components. Accordingly, the cooling system 126, 126' may be varied between different configurations, depending on the current operating condition of the vehicle. Therefore, the vehicle and its subsystems may be operated and cooled in an efficient manner in a variety of operating conditions (cold weather, warm weather, cold engine, warm engine, etc.).

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An engine for a vehicle comprising:

an exhaust gas recirculation (EGR) system configured to receive exhaust gas produced by the engine and recirculate the exhaust gas back to the engine, the EGR system including an EGR component;

a cooling system configured for selective cooling of the engine and the EGR component, the cooling system including:

a coolant pump; and a plumbing system with a plurality of flow branches arranged to circulate coolant pumped by the coolant pump through the cooling system, the plurality of flow branches including an engine branch defining an engine flow passage through which the coolant flows to cool the engine, an EGR branch defining an EGR flow passage through which the coolant flows to cool the EGR component, and a feed branch defining a feed flow passage;

wherein the cooling system has a first operating configuration in which the EGR flow passage is configured to receive coolant flow from the engine flow passage; and wherein the cooling system has a second operating configuration in which the EGR flow passage is configured to receive coolant flow from the feed flow passage instead of the engine flow passage.

2. The engine of claim 1, wherein in the first operating configuration, the EGR flow passage is configured to receive coolant flow from both the engine flow passage and the feed flow passage.

3. The engine of claim 1, further comprising an EGR feed valve configured to move between a first position and a second position;

wherein the EGR feed valve is configured to change a flow characteristic through the feed flow passage as the EGR feed valve moves between the first position and the second position;

wherein the EGR feed valve is in the first position in the first operating configuration; and wherein the EGR feed valve is in the second position in the second operating configuration.

4. The engine of claim 3, wherein the first position of the EGR feed valve is a closed position; and wherein the EGR feed valve, in the closed position, is configured to prevent coolant from flowing from the feed flow passage to the EGR flow passage.

5. The engine of claim 3, wherein the EGR feed valve, in the first position, allows a first coolant flow rate from the feed flow passage to the EGR flow passage;

wherein the EGR feed valve, in the second position, allows a second coolant flow rate from the feed flow passage to the EGR flow passage; and wherein the first coolant flow rate is less than the second coolant flow rate.

6. The engine of claim 3, wherein the EGR feed valve includes a one-way check valve.

7. The engine of claim 1, wherein the feed branch includes an orifice member configured to limit flow through the feed branch.

8. The engine of claim 1, further comprising a common branch that defines a common flow passage;

wherein the engine branch and the feed branch extend in parallel from the common branch such that both the engine flow passage and the feed flow passage are configured to receive coolant flow from the common flow passage.

9. The engine of claim 8, further comprising a direct flow branch that receives coolant flow from the common flow passage, wherein the direct flow branch bypasses both the EGR flow passage and the engine flow passage.

10. The engine of claim 1, further comprising a first downstream component and a second downstream component;

wherein the plurality of branches includes a first downstream branch and a second downstream branch;

wherein the first downstream branch defines a first downstream flow passage through which the coolant flows to exchange heat with the first downstream component;

wherein the second downstream branch defines a second downstream flow passage through which the coolant flows to exchange heat with the second downstream component; and wherein the first downstream flow passage is configured to receive flow from the EGR flow passage; and wherein the second downstream flow passage is configured to receive flow from the engine flow passage.

11. The engine of claim 10, wherein the first downstream component is at least one of an engine oil heater, a transmission oil heater, and a heater coil; and wherein the second downstream component is a radiator.

12. The engine of claim 10, wherein the plurality of branches includes a common return branch configured to return coolant flow received from both the first and second downstream flow passages to the coolant pump.

13. An engine for a motor vehicle comprising:

an exhaust gas recirculation (EGR) system configured to receive exhaust gas produced by the engine and recirculate the exhaust gas back to the engine, the EGR system including an EGR component;

a cooling system configured for selective cooling of the engine and the EGR component, the cooling system including:

a coolant pump; and a plumbing system with a plurality of flow branches arranged to circulate coolant pumped by the coolant pump through the cooling system to the engine and to the EGR system;

wherein the cooling system is operable in a first operating configuration to fluidly connect the engine to the EGR system in series and a second operating configuration to fluidly connect the engine to the EGR system in parallel.

14. The engine of claim 13, wherein, in the first operating configuration, the plumbing system fluidly connects the engine and the EGR system such that the EGR system is downstream of the engine and receives coolant flow from the engine.

15. The engine of claim 13, wherein the plurality of flow branches comprises an EGR feed branch with an EGR feed valve configured to move between a first position and a second position;

wherein, in the first operating configuration, the EGR feed valve is in the first position to prevent coolant from flowing through the EGR feed branch; and wherein, in the second operating configuration, the EGR feed valve is in the second position to allow coolant to flow through the EGR feed branch to the EGR system.

16. The engine of claim 15, wherein the EGR feed valve comprises a one-way check valve.

17. The engine of claim 15, wherein the plurality of flow branches further comprises a common branch that defines a common flow passage from the pump and an engine branch that defines an engine flow passage that extends from the common branch and provides coolant flow to the engine, wherein the EGR feed branch extends from the common branch in parallel to the engine branch.

18. The engine of claim 17, further comprising a direct flow branch that receives coolant flow from the common flow passage, wherein the direct flow branch bypasses both the EGR system and the engine system.

19. The engine of claim 17, wherein the plurality of flow branches comprises an EGR branch configured to provide coolant to the EGR system in the first configuration;

wherein the EGR branch is configured to provide coolant to the EGR system in the second configuration; and wherein the EGR feed branch includes a downstream end that is fluidly connected to the EGR branch, upstream of the EGR system.

20. The engine of claim 19, wherein the EGR branch comprises a plurality of sub-branches that are fluidly connected in parallel;

wherein the plurality of sub-branches includes a first sub-branch configured to provide coolant to a first EGR component of the EGR system;

wherein the plurality of sub-branches includes a second sub-branch configured to provide coolant to a second EGR component of the EGR system;

wherein the plurality of sub-branches includes a third sub-branch configured to provide coolant to at least one of a throttle and a turbocharger component.

* * * * *